US007562663B2

(12) United States Patent
Muraoka et al.

(10) Patent No.: US 7,562,663 B2
(45) Date of Patent: Jul. 21, 2009

(54) HIGH-PRESSURE PROCESSING APPARATUS AND HIGH-PRESSURE PROCESSING METHOD

(75) Inventors: Yusuke Muraoka, Kyoto (JP); Tomomi Iwata, Kyoto (JP); Kimitsugu Saito, Kyoto (JP); Masahiro Yamagata, Hyogo (JP); Hisanori Oshiba, Hyogo (JP); Shogo Sarumaru, Hyogo (JP)

(73) Assignee: Dainippon Screen Mfg. Co., Ltd. (JP)

( * ) Notice: Subject to any disclaimer, the term of this patent is extended or adjusted under 35 U.S.C. 154(b) by 566 days.

(21) Appl. No.: 10/772,546

(22) Filed: Feb. 5, 2004

(65) Prior Publication Data

US 2004/0182419 A1 Sep. 23, 2004

(30) Foreign Application Priority Data

Mar. 19, 2003 (JP) ..... 2003-075556

(51) Int. Cl.
*B08B 3/00* (2006.01)
*B08B 3/04* (2006.01)

(52) U.S. Cl. ..... 134/94.1; 134/93; 134/95.1; 134/98.1; 134/99.2; 134/100.1; 134/184; 134/200; 239/93

(58) Field of Classification Search ..... 134/94.1, 134/95.3, 103.2, 198, 200, 93, 95.1, 98.1, 134/99.2, 100.1, 184; 239/93, 738
See application file for complete search history.

(56) References Cited

U.S. PATENT DOCUMENTS

| | | | | |
|---|---|---|---|---|
| 5,332,311 | A * | 7/1994 | Volk et al. | 366/134 |
| 5,369,032 | A * | 11/1994 | Pratt | 435/286.7 |
| 5,666,987 | A * | 9/1997 | Combs | 137/1 |
| 6,306,564 | B1 * | 10/2001 | Mullee | 430/329 |

FOREIGN PATENT DOCUMENTS

| | | |
|---|---|---|
| JP | 2000-58492 | 2/2000 |
| JP | 2002-313764 | 10/2002 |
| WO | 02/080233 | 10/2002 |

* cited by examiner

*Primary Examiner*—Michael Barr
*Assistant Examiner*—Rita R Patel
(74) *Attorney, Agent, or Firm*—Ostrolenk, Faber, Gerb & Soffen, LLP

(57) ABSTRACT

A mixing valve assembly 42 is communicated with a dedicated tank 51D, storing therein a compatibilizer D, via an inlet valve 43 and is also communicated with dedicated tanks 51A-51C via three injection valves, the tanks storing therein auxiliaries A-C respectively. A chemical formulation is prepared by selectively injecting any one(s) of four chemical agents into the mixing valve assembly 42 by way of on-off control of the inlet valve 43 and the injection valves and blending together the injected chemical agents. Then, the chemical formulation is pumped into SCF by a high-pressure pump 45 such that the SCF and the chemical formulation are mixed together to form a process fluid. Thus, the number of components of a high-pressure portion can be reduced to achieve a cost reduction of an apparatus. Furthermore, a pipe line for pumping the chemical agents is simplified.

7 Claims, 6 Drawing Sheets

HIGH-PRESSURE PROCESSING APPARATUS AND HIGH-PRESSURE PROCESSING METHOD

BACKGROUND OF THE INVENTION

1. Field of the Invention

The present invention relates to a high-pressure processing apparatus and a high-pressure processing method which subject a surface of a process subject to a predetermined surface treatment by allowing a process fluid to contact the surface of the process subject, the process fluid comprising a high-pressure fluid or a mixture of the high-pressure fluid and a chemical agent. The process subject includes a variety of substrates such as semiconductor wafers, glass substrates for photomask, glass substrates for liquid crystal display, glass substrates for plasma display, and optical disk substrates (hereinafter, simply referred to as "substrate").

2. Description of the Related Art

In a case where a resist is used for forming a pattern in a semiconductor fabrication process, a cleaning step is required for removing unwanted substances and contaminants from the substrate, the unwanted substances and contaminants including the resist becoming no more necessary after the pattern formation, etching polymer produced during an etching process and remaining on the substrate, and the like. Hence, a high-pressure processing apparatus is known which performs the cleaning process on the substrate by exposing the substrate surface to the process fluid comprising the mixture of the high-pressure fluid and the chemical agent.

In a high-pressure processing apparatus disclosed in Japanese Unexamined Patent Publication No. 2002-313764 (hereinafter, referred to as "Patent Document 1"), the cleaning of the substrate is performed by supplying a process fluid to a processing chamber with the substrate set therein, the process fluid comprising a mixture of a high-pressure fluid and a plurality of chemical agents. More specifically, the high-pressure processing apparatus includes: high-pressure fluid supply means for supplying the high-pressure fluid to the processing chamber; first chemical-agent supply means for supplying a first chemical agent to the processing chamber; and second chemical-agent supply means for supplying a second chemical agent to the processing chamber. These supply means are each provided with a pressure pump (high-pressure pump) in order to pump the high-pressure fluid or the chemical agent to the processing chamber.

The above high-pressure processing apparatus of Patent Document 1 requires the pressure pumps to be provided by the number of types of the chemical agents because the chemical-agent supply means is provided in correspondence to each chemical agent to be admixed with the high-pressure fluid. The pressure pump is generally expensive and hence, the increase in the number of pressure pumps provided directly results in an increased cost of the high-pressure processing apparatus. Particularly, there is a tendency to use an increasing number of chemical agents for the purpose of improving the versatility or performance of the high-pressure processing apparatus. This tendency constitutes one of major factors increasing the fabrication costs of the high-pressure processing apparatus.

Furhtermore, the high-pressure processing apparatus need be so arranged as to pump the plural chemical agents from the respective pressure pumps and to supply all or selected one(s) of the chemical agents to the processing chamber. On this account, there are provided high-pressure valves and high-pressure pipes between the individual pressure pumps and the processing chamber. This entails a similar problem to the above. That is, as the number of types of used chemical agents increases, the number of components, such as the high-pressure valve and the high-pressure pipe, increases correspondingly. This results in the increased fabrication costs of the high-pressure processing apparatus. Furthermore, the pipe line is complicated, leading to another problem that the construction of the apparatus is complicated.

SUMMARY OF THE INVENTION

A primary object of the invention is to achieve the construction simplification and cost reduction of the high-pressure processing apparatus and method for subjecting a surface of a process subject to a predetermined surface treatment by allowing a process fluid to contact the surface of the process subject, the process fluid prepared by mixing a high-pressure fluid with all or any one(s) of plural chemical agents.

The present invention relates to a high-pressure processing apparatus for subjecting a surface of a process subject to a predetermined surface treatment by allowing a process fluid comprising a high-pressure fluid or a mixture of the high-pressure fluid and a chemical agent to contact the surface of the process subject. To achieve the object above, one aspect of the high-pressure processing apparatus according to the present invention comprises: a pressure vessel including a processing chamber defined therein for performing the surface treatment; high-pressure fluid supply means for supplying the high-pressure fluid to the processing chamber; and chemical-agent supply means which prepares a chemical formulation by blending together all or selected one(s) of plural chemical agents and then, as required, pumps the chemical formulation into the high-pressure fluid pumped from the high-pressure fluid supply means to the processing chamber or pumps the chemical formulation directly to the processing chamber.

The other aspect of the high-pressure processing apparatus according to the present invention comprises: a plurality of pressure vessels each including a processing chamber defined therein for performing the surface treatment; high-pressure fluid supply means for supplying the high-pressure fluid to the plural processing chambers; a plurality of common tanks individually storing therein a respective one of plural chemical agents; and a plurality of chemical-agent supply means which are each provided in correspondence to a respective one of the plural processing chambers, and which each prepares a chemical formulation for the corresponding processing chamber by blending all or selected one(s) of the plural chemical agents supplied from the plural common tanks and then, as required, pumps the chemical formulation into the high-pressure fluid pumped from the high-pressure supply means to the processing chamber or pumps the chemical formulation directly to the processing chamber.

With such a structure according to the present invention, the process fluid is prepared by mixing the high-pressure fluid with all or any one(s) of plural chemical agents as required, and then the surface treatment for the process subject is carried out with the process fluid. The mixing the high-pressure fluid with the chemical agent(s) is carried out as follows. First, the chemical formulation is prepared by blending together all or selected one(s) of plural chemical agents before the mixing. Next, the chemical formulation is pumped into the high-pressure fluid or the processing chamber, the above mixing is carried out. In this manner, the present invention has an arrangement to pump the chemical formulation into the high-pressure fluid pumped to the processing chamber or pump the chemical formulation to the processing chamber after the chemical formulation is prepared under low-pressure, instead of pumping the plural chemical agents to be mixed with the high-pressure fluid individually like the conventional apparatus. Therefore, the number of components for pumping the chemical agents (such as the high-pressure pump, high-pressure valve and high-pressure pipe) can be reduced and a pipe line for pumping the chemical agents can be simplified to achieve a notable cost reduction of the apparatus.

The present invention relates to a high-pressure processing method for subjecting a surface of a process subject to a predetermined surface treatment by allowing a process fluid comprising a high-pressure fluid or a mixture of the high-pressure fluid and a chemical agent to contact the surface of the process subject. To achieve the object above, one aspect of the high-pressure processing method according to the present invention comprises the steps of: pumping the high-pressure fluid to a processing chamber accommodating therein the process subject; preparing a chemical formulation by blending together the plural chemical agents and then pumping the chemical formulation to the processing chamber; and forming the process fluid by mixing the high-pressure fluid with the chemical formulation at place upstream from the processing chamber and then supplying the process fluid to the processing chamber.

The other aspect of the high-pressure processing method according to the present invention comprises the steps of: pumping the high-pressure fluid to a processing chamber accommodating therein the process subject; preparing a chemical formulation by blending together the plural chemical agents and then pumping the chemical formulation to the processing chamber; and forming the process fluid by mixing the high-pressure fluid with the chemical formulation in the processing chamber.

With such a structure according to the present invention, similarly to the above high-pressure processing apparatus, the chemical formulation is prepared by blending together all or selected one(s) of plural chemical agents, and then the process fluid is formed by pumping the chemical formulation into the high-pressure fluid or the processing chamber to be mixed with the high-pressure fluid. Therefore, a surface treatment on the process subject can be carried out in a simple construction of the apparatus , and at low cost.

It is noted here that the "surface of the process subject" means a surface to be subjected to a high-pressure process. In a case where the process subject is any one of the semiconductor wafers, glass substrates for photomask, glass substrates for liquid crystal display, glass substrates for plasma display and optical disk substrates, for example, and where the surface treatment need be performed on one of two primary surfaces of the substrate that is formed with a circuit pattern or the like, this primary surface is equivalent to the "surface of the process subject" of the invention. Where the other primary surface need be subjected to the surface treatment, the other primary surface is equivalent to the "surface of the process subject" of the invention. Where the surface treatment need be performed on the two primary surfaces such as of a double-sided mounting substrate, for example, the two primary surfaces are equivalent to the "surface of the process subject" as a matter of course.

The surface treatment according to the invention may typically be exemplified by a cleaning process for separating/removing contaminants from the process subject to which the contaminants adhere, such as a semiconductor substrate with a resist adhered thereto. The process subject is not limited to the semiconductor substrate and may include various types of substrates such as formed of metals, plastics and ceramics, the substrates on which a non-continuous or continuous layer of material of a different kind is formed or remains. The application of the high-pressure processing apparatus and method of the invention is not limited to the cleaning process but may include all the other processes (e.g., drying process, developing process and the like) that are directed to remove unwanted substances from the process subject using the high-pressure fluid and a chemical agent other than the high-pressure fluid.

According to the invention, carbon dioxide is preferred as a usable high-pressure fluid from the viewpoint of safety, cost and easiness to transform into supercritical state. Other usable fluids than carbon dioxide include water, ammonia, nitrous oxide, ethanol and the like. The reason for using the high-pressure fluid is that the high-pressure fluid has such a high diffusion coefficient as to be able to diffuse dissolved contaminants in a medium. Where the fluid is transformed into a supercritical fluid as subjected to an even higher pressure, the fluid assumes a intermediate property between those of gas and liquid such that the resultant fluid is allowed to penetrate more deeply into a micro-pattern. In addition, the high-pressure fluid has a density comparable to that of liquid and thence is capable of containing a much greater amount of additive (chemical agent) than gas.

It is noted here that the high-pressure fluid according to the invention is a fluid having a pressure of at least 1 MPa. A high-pressure fluid having properties of high density, high solubility, low viscosity and high diffusivity may favorably be used. More preferred is a fluid in a supercritical state or a sub-supercritical state. Carbon dioxide may be transformed into a supercritical fluid by exposing carbon dioxide to conditions of 31° C. and 1 MPa or more. It is preferred to use a sub-supercritical or supercritical fluid of 5 to 30 MPa in the cleaning step as well as in the subsequent rinsing step, drying/developing step and the like. It is more preferred to perform these steps under the pressure of 7.1 to 20 MPa. While the following "DETAILED DESCRIPTION OF THE PREFERRED EMBODIMENTS" will be described with reference to cases where a cleaning process and a drying process are performed as the surface treatment, the high-pressure processing is not limited to the cleaning process, rinsing process and drying process, as described above.

According to the invention, consideration is given to that where a process fluid consists of a high-pressure fluid alone, such as carbon dioxide, the process fluid falls short of providing a sufficient detergency because the cleaning process is to remove the resist and high-polymer contaminants, such as an etching polymer, which adhere to the substrate. Hence, the cleaning process is performed using the high-pressure fluid admixed with a chemical agent. As to the chemical agent, a basic compound may preferably be used as a detergent component. This is because the basic compound has an action of hydrolyzing a polymer substance commonly used as the resist, thus presenting a high detergent effect. A specific example of the basic compound includes at least one selected from the group consisting of quaternary ammonium hydroxide, quaternary ammonium fluoride, alkylamine, alkanolamine, hydroxylamine ($NH_2OH$) and ammonium fluoride ($NH_4F$). The detergent component may preferably be present in concentrations of 0.05 to 8 mass % based on the high-pressure fluid. Where the high-pressure processing apparatus of the invention is used for the drying or developing process, xylene, methyl isobutyl ketone, a quaternary ammonium compound, a fluorine-base polymer or the like may be selected as the chemical agent according to the properties of the resist to be dried or developed.

Where the detergent component such as the aforementioned basic compound is poorly soluble in the high-pressure fluid, it is preferred to employ, as the chemical agent, a compatibilizer capable of serving as an auxiliary for dissolving or homogeneously dispersing the detergent component in the high-pressure fluid. The compatibilizer also acts to prevent re-adherence of contaminants in the rinsing step following the cleaning step. Furthermore, the compatibilizer also effectively promotes the removal of the auxiliary (chemical agent) from high-pressure pipes 41, 31 extended from a mixing valve assembly 42 (FIG. 2) to a pressure vessel 1 (FIG. 1) and a high-pressure pump 45; a high-pressure valve 46; a heater 33; and the pressure vessel 1 interposed in the high-pressure pipe, the auxiliary used in the cleaning step.

The compatibilizer is not particularly limited so long as it can compatibilize the detergent component with the high-pressure fluid. Preferred examples of such a compatibilizer include alcohols such as methanol, ethanol and isopropanol; and alkyl sulfoxides such as dimethyl sulfoxide. In the cleaning step, the compatibilizer may be used in a suitable amount selected from the range of 50 mass % or less based on the high-pressure fluid.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
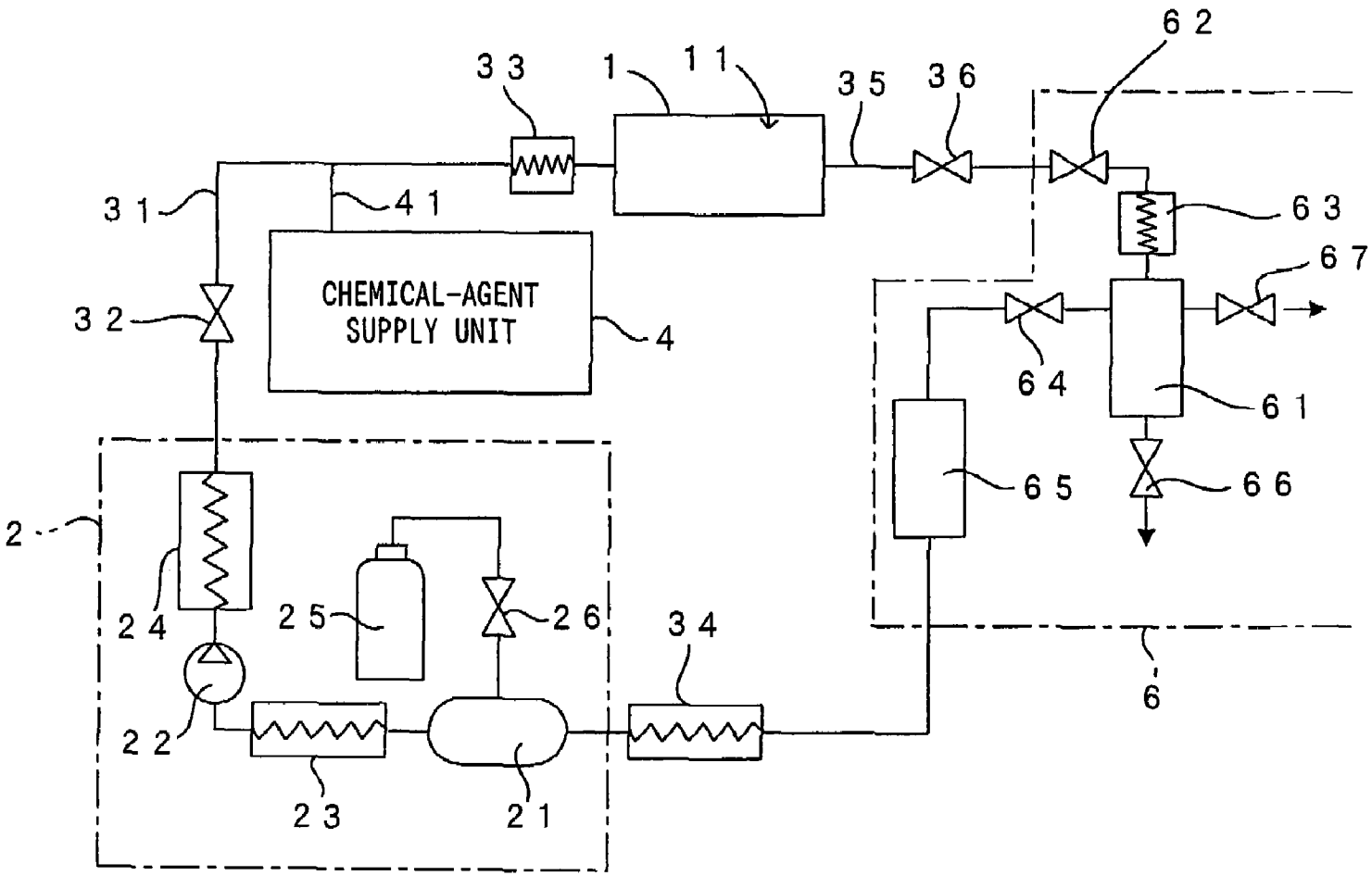
FIG. 1 is a diagram showing a high-pressure processing apparatus according to one embodiment of the invention.

FIG. 1 is a diagram showing a high-pressure processing apparatus according to one embodiment of the invention. The high-pressure processing apparatus is adapted to introduce, as a process fluid, supercritical carbon dioxide or a mixture of supercritical carbon dioxide and a chemical agent into a processing chamber 11 formed internally of a pressure vessel 1, and to perform predetermined cleaning process, rinsing process and drying process on a substrate such as a substantially circular semiconductor wafer (process subject) retained in the processing chamber 11. The arrangement and operations of the apparatus will hereinbelow be described in details.

The high-pressure processing apparatus is provided with a high-pressure fluid supply unit 2 for pumping supercritical carbon dioxide (hereinafter referred to as "SCF"), as the "high-pressure fluid" of the invention, to the processing chamber 11. The high-pressure fluid supply unit 2 includes a reservoir 21 for high-pressure fluid and a high-pressure pump 22 as essential components as well as a supercooling device 23, a heater 24, a high-pressure cylinder 25 and a high-pressure valve 26 as illustrated in the figure. In a case where liquefied or supercritical carbon dioxide is used as the high-pressure fluid as described above, the reservoir 21 normally contains therein liquefied carbon dioxide. Where there is a great piping pressure loss including acceleration resistance, the fluid may be previously cooled by the supercooling device 23 in order to prevent the fluid from being gasified in the high-pressure pump 22. A high-pressure liquefied carbon dioxide may be obtained by pressurizing the fluid by means of the high-pressure pump 22.

In cases where the processing chamber 11 is opened to the atmosphere, the system reduced in the amount of carbon dioxide therein need be replenished with carbon dioxide. Where carbon dioxide in liquid state is replenished by the high-pressure cylinder 25 containing therein liquefied carbon dioxide, the liquid carbon dioxide may be supplied directly to the reservoir 21 via the high-pressure valve 26. Where carbon dioxide in gas state is replenished, an arrangement may be made wherein a gaseous carbon dioxide is supplied via a condenser to be described hereinlater. The heater 24 serves to heat carbon dioxide to a surface treatment temperature. However, an alternative arrangement may be made such that carbon dioxide is previously heated to below the treatment temperature or otherwise is unheated, and then a heater (described hereinlater), disposed in the vicinity of the processing chamber 11, heats the carbon dioxide to a temperature suited for the surface treatment performed in the processing chamber 11.

The heater 24 of the high-pressure fluid supply unit 2 is communicated with the processing chamber 11 via the high-pressure pipe 31. The high-pressure pipe 31 has a high-pressure valve 32 and a heater 33 interposed therein. When the high-pressure valve 32 is opened in response to an open command from a control unit (not shown) controlling the allover apparatus, the SCF pumped out from the high-pressure fluid supply unit 2 is supplied to the processing chamber 11 via the heater 33. Conversely when the high-pressure valve 32 is closed, the SCF supply to the processing chamber 11 is stopped.

A high-pressure pipe 41 extended from a chemical-agent supply unit 4 is connected to a pipe portion extended between the high-pressure valve 32 and the heater 33 such that a chemical formulation from the chemical-agent supply unit 4 may be pumped into the SCF being pumped through the high-pressure pipe 31 to the processing chamber 11, so as to be mixed with the SCF at the junction. In this manner, the junction according to the embodiment functions as a mixing portion. Where the chemical formulation is pumped out from the chemical-agent supply unit 4, a mixture of the SCF and the chemical formulation, as a "process fluid" of the invention, is formed at the mixing portion and is supplied to the processing chamber 11 via the heater 33. Where, on the other hand, the chemical formulation is not pumped out from the chemical-agent supply unit 4, the SCF alone, as the "process fluid" of the invention, is supplied to the processing chamber 11 via the heater 33. The heater 33 is disposed near an SCF inlet port of the processing chamber 11 so as to adjust the temperature of the process fluid just before the process fluid is introduced into the processing chamber 11. As a matter of course, therefore, the heater 33 may be dispensed with where the process fluid need not be adjusted for the temperature thereof.

Figure 2:
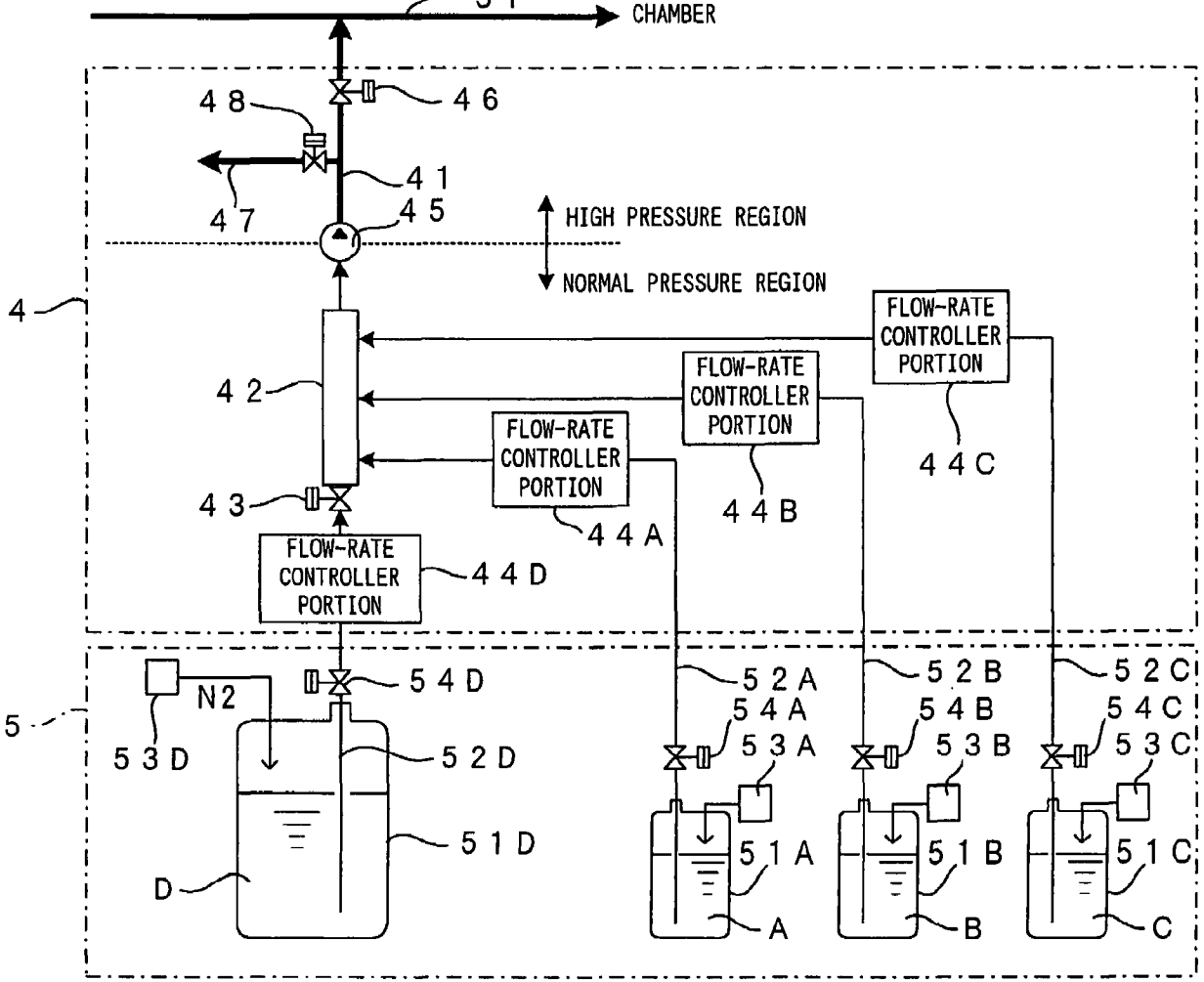
FIG. 2 is a diagram showing an arrangement of a chemical agent supply unit.

FIG. 2 is a diagram showing an arrangement of the chemical-agent supply unit. The chemical-agent supply unit 4 is supplied with four types of chemical agents (a compatibilizer D, an auxiliary A, an auxiliary B and an auxiliary C) from a chemical-agent storage unit 5 and prepares a chemical formulation by blending together all or selected one(s) of these the chemical agents. In the chemical-agent supply unit 4, a mixing valve assembly 42 is provided as "blending means" for performing a blending operation.

The mixing valve assembly 42 is communicated with a dedicated tank 51D of the chemical-agent storage unit 5 via an inlet valve 43. The compatibilizer D is previously stored in the dedicated tank 51D. A leading end of a pipe 52D is dipped in the compatibilizer D whereas a trailing end of the pipe 52D is connected with the inlet valve 43 of the mixing valve assembly 42. A nitrogen-gas supply portion 53D is provided in correspondence to the dedicated tank 51D. The nitrogen-gas supply portion 53D pumps nitrogen gas into the dedicated tank 51D thereby feeding the compatibilizer D held in the dedicated tank 51D to the mixing valve assembly 42 via the pipe 52D. Interposed in the pipe 52D are a bottom valve 54D for the dedicated tank 51D and a flow-rate controller portion 44D for the compatibilizer D. The control unit controls the operations of the nitrogen-gas supply portion 53D, the bottom valve 54D, the flow-rate controller portion 44D and the inlet valve 43, thereby controllably supplying the compatibilizer D to the mixing valve assembly 42 or stopping the supply of the compatibilizer. In order to feed the individual auxiliaries A-C respectively stored in dedicated tanks 51A-51C to the mixing valve assembly 42, pipes 52A-52C, nitrogen-gas supply portions 53A-53C, bottom valves 54A-54C and flow-rate controller portions 44A-44C are provided in correspondence to the respective auxiliaries A-C similarly to the compatibilizer D. The arrangement and operations of these components are the same as those of the components belonging to the compatibilizer D and hence, the description thereof is dispensed with. According to the embodiment, the compatibilizer D and three types of auxiliaries A-C are provided as "plural types of chemical agents" of the invention. However, the combination of the chemical agents and the types thereof are optional and plural types of chemical agents may properly be selected according to the surface treatment.

Figure 3A:
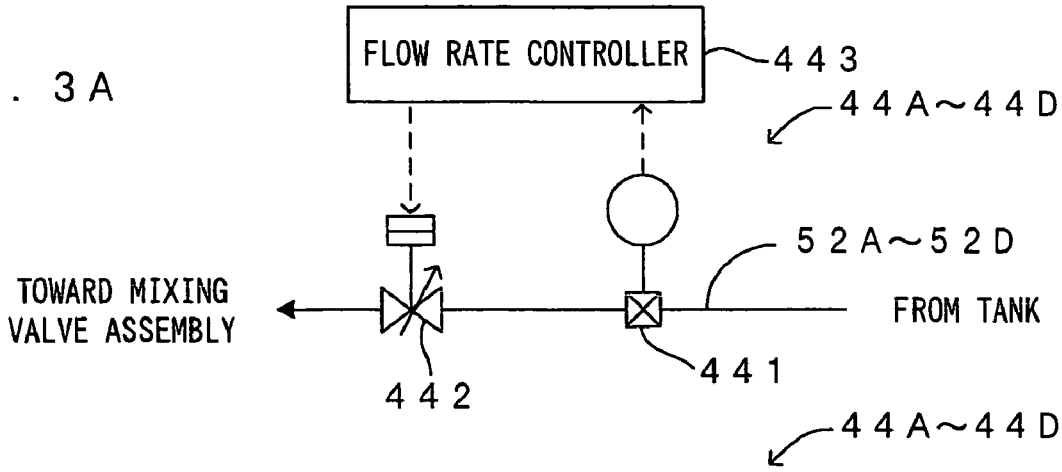
FIGS. 3 are diagrams each showing an arrangement of a flow-rate controller portion.
Figure 3B:
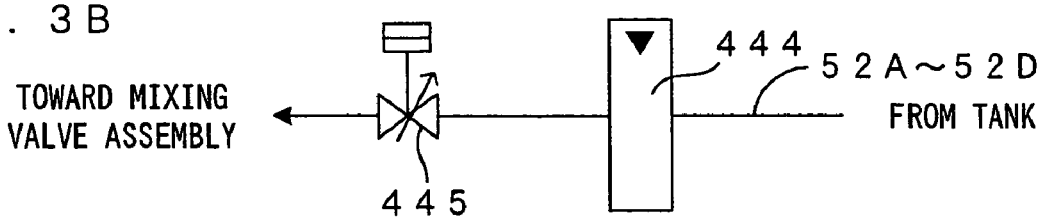

FIG. 3 are diagrams each showing an arrangement of a flow-rate controller portion. All the flow-rate controller portions 44A-44D have the same construction. As shown in FIG. 3A, the flow-rate controller portions 44A-44D each include a flow meter 441, an adjustable throttle valve 442 and a flow rate controller 443 which are interposed in each of the pipes 52A-52D connected to the mixing valve assembly 42. The flow rate controller 443 receives a flow-rate signal from the flow meter 441 and performs feedback control of the aperture of the adjustable throttle valve 442 based on the received flow-rate signal and a flow rate command from the control unit thereby controlling the flow rate of the chemical agent supplied to the mixing valve assembly 42. Therefore, the compatibilizer D and the three types of auxiliaries A-C all can be accurately controlled in their respective inflows into the mixing valve assembly 42. As a result, the mixing valve assembly 42 is allowed to adjust the blending proportions of the individual chemical agents with high accuracies. Furthermore, the blending proportions can be re-defined in real time and with high accuracies by changing the flow rate command from the control unit. Where there is no need for accurate control of the flow rate of the chemical agent on a real-time basis, the flow-rate controller portions 44A-44D may have an alternative arrangement comprised of a flow meter 444 and a fixed throttle valve 445 as shown in FIG. 3B. Otherwise, the combination of the flow meter 441, adjustable throttle valve 442 and flow rate controller 443 may be replaced by a metering pump having an excellent constant-flow supply performance. In this case, the blending proportions of the individual chemical agents may be changed in real time by adjusting the number of rotation of the metering pump based on the flow-rate command from the control unit.

Figure 4:
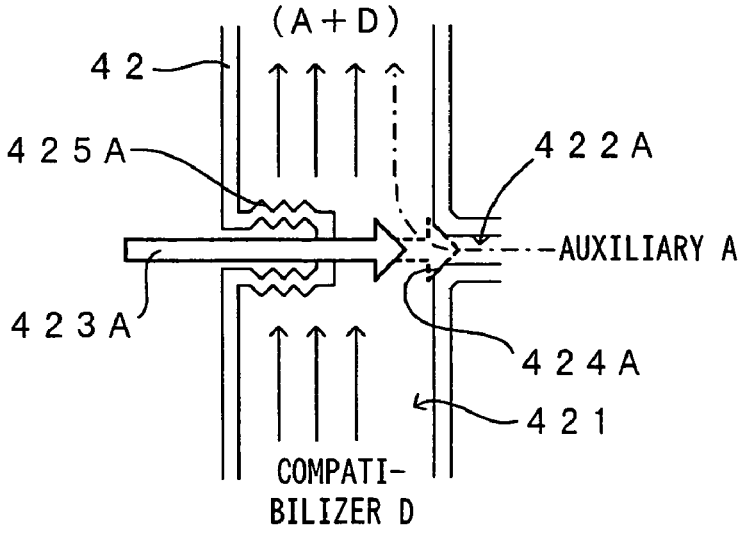
FIG. 4 is a fragmentary sectional view of a mixing valve assembly.

FIG. 4 is a fragmentary sectional view of a mixing valve assembly. Provided internally of the mixing valve assembly 42 employed by the embodiment are a primary flow path 421 having a relatively wider section and an auxiliary flow path 422A narrower than the primary flow path 421 and communicated therewith. One end of the primary flow path 421 is communicated with the inlet valve 43 whereas the other end thereof is communicated with the high-pressure pump 45 which is equivalent to "pumping means" of the invention. Hence, the compatibilizer D introduced via the inlet valve 43 flows through the primary flow path 421 toward the high-pressure pump 45 (to the upper side as seen in the figure).

The auxiliary flow path 422A is a path for introducing the auxiliary A into the primary flow path 421. In a state where a movable member 423A is moved away from a communication port 424A, as shown in the figure, the auxiliary A flows into the primary flow path 421 via the auxiliary flow path 422A and the communication port 424A, so that the auxiliary A along with the compatibilizer D flow toward the high-pressure pump 45 (to the upper side as seen in the figure). When, on the other hand, the movable member 423A is moved to the communication port 424A (the right-hand side as seen in the figure) in response to a drive command from the control unit thereby to close the communication port 424A with its distal end, the inflow of the auxiliary A into the primary flow path 421 is inhibited and hence, the auxiliary A is prevented from being admixed with the compatibilizer D. It is noted that a reference character 425A represents an accordion portion extendable in conjunction with the positional movement of the movable member 423A.

In this manner, the embodiment controls the injection or stoppage of the injection of the auxiliary A by controlling the position of the movable member 423A. Thus, the movable member 423A functions as an injection valve for controlling the injection of the auxiliary A into the mixing valve assembly 42. Although not shown in FIG. 4, a similar arrangement is provided with respect to the other auxiliaries B and C so as to permit the control of the injection or stoppage of the injection of each auxiliary B, C into the compatibilizer D. Accordingly, the control unit may control the positional movement of the individual movable members for permitting the mixing valve assembly 42 to prepare eight kinds of chemical formulations: (1) the compatibilizer D alone; (2) the compatibilizer D+the auxiliary A; (3) the compatibilizer D+the auxiliary B; (4) the compatibilizer D+the auxiliary C; (5) the compatibilizer D+the auxiliary A+the auxiliary B; (6) the compatibilizer D+the auxiliary A+the auxiliary C; (7) the compatibilizer D+the auxiliary B+the auxiliary C; and (8) the compatibilizer D+the auxiliary A+the auxiliary B+the auxiliary C. In addition, the blending proportions of the chemical formulation can be controlled by regulating the respective flow rates of the auxiliaries A-C and the compatibilizer D by means of the flow-rate controller portions 44A-44D, as described above. Therefore, a wide variety of chemical formulations may be prepared by combining these controls.

The chemical formulation prepared by the mixing valve assembly 42 flows into the high-pressure pump 45, as shown in FIG. 2, so as to be pumped to the junction via the high-pressure pipe 41. A high-pressure valve 46 is interposed in the high-pressure pipe 41. When the high-pressure valve 46 is opened in response to an open command from the control unit, the chemical formulation is pumped to the junction with the high-pressure pipe 31 so as to be admixed with the SCF pumped through the high-pressure pipe 31. Thus, the resultant mixture (SCF+chemical formulation), as the "process fluid" of the invention, is pumped to the processing chamber 11. When, on the other hand, the high-pressure valve 46 is closed in response to a close command from the control unit, the pumping of the chemical formulation to the above junction is inhibited. As a result, the SCF alone, as the "process fluid" of the invention, is pumped to the processing chamber 11. A high-pressure pipe 47 is branched from the high-pressure pipe 41 such that the chemical formulation in the pipe 41 may be drained by opening a high-pressure valve 48 interposed in the high-pressure pipe 47.

Next, returning to FIG. 1, the explanation of the arrangement of the high-pressure processing apparatus is continued. The process fluid (SCF alone or SCF+chemical formulation) pumped from the junction of the high-pressure pipes 31, 41 is heated by the heater 33, as required, and then fed into the processing chamber 11. Thus is performed a predetermined surface treatment on the substrate placed in the processing chamber 11. The details of the processing operation will be described hereinlater.

The processing chamber 11 is communicated with a separation/recovery unit 6 via a high-pressure pipe 35. The high-pressure pipe 35 has a high-pressure valve 36 interposed therein. When a high-pressure valve 36 is opened in response to an open command from the control unit, the process fluid and the like in the processing chamber 11 are discharged into the separation/recovery unit 6. When, on the other hand, the high-pressure valve 36 is closed, the process fluid can be confined in the processing chamber 11.

In the separation/recovery unit 6, a separator 61 is communicated with the processing chamber 11 via the high-pressure pipe 35 such that the SCF, chemical agent, contaminants and such in the processing chamber 11 may be pumped to the separator 61 via a high-pressure valve 62 and a gasifier 63. In the separator 61, the SCF is transformed into a gas component by depressurization operation and the resultant gas component is guided into a purifier 65 via a gas-component high-pressure valve 64 so as to be purified. The high-purity carbon dioxide is transported from the purifier 65 to a condenser 34 where the carbon dioxide is liquefied before it is returned to the reservoir 21. Thus, the carbon dioxide is recycled. The purifier 65 may be exemplified by an adsorption column filled with an adsorbent such as an active carbon, and the like.

A mixture of the contaminants and chemical agent(s) resulting from gas/liquid separation by the separator 61 is discharged from a column bottom of the separator 61 via a high-pressure valve 66 for liquid (or solid) component and then processed as required. Alternatively, the gas component resulting from the gas/liquid separation by the separator 61 may not be recycled but may be released into the atmosphere via a gas-component high-pressure valve 67. As the separator 61, there may be used a variety of devices adapted for gas/liquid separation, centrifugal separators and the like.

Figure 5:
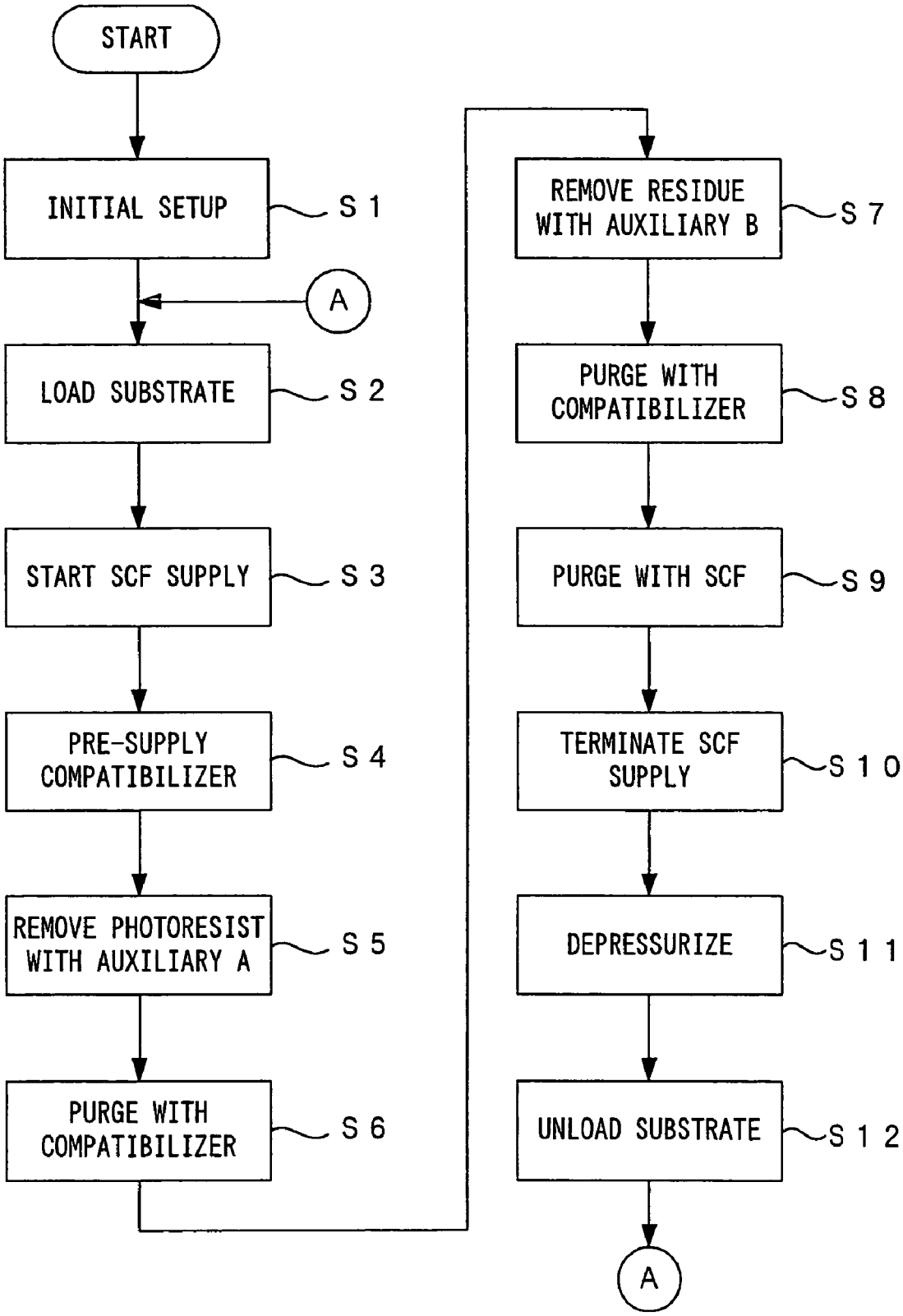
FIG. 5 is a flow chart showing one exemplary operation of the high-pressure processing apparatus of FIG. 1.

Next, an exemplary operation of the high-pressure processing apparatus of the above arrangement will be described with reference to FIG. 5. FIG. 5 is a flow chart showing one exemplary operation of the high-pressure processing apparatus of FIG. 1. The description is made on a case where the control unit controls the individual parts of the apparatus based on a surface treatment program previously stored in a memory, thereby carrying out a sequence of surface treatment operations for cleaning a photoresist off the substrate surface using the three types of chemical agents including the auxiliary A, auxiliary B and compatibilizer D, the photoresist adhered to the substrate surface.

Firstly in Step S1, the flow rates of the auxiliary A and the auxiliary B are preset to given values as an initial setup for performing the aforementioned surface treatment operations. In addition, the bottom valves 54D, 54A, 54B for the compatibilizer D, the auxiliary A and the auxiliary B are opened, respectively. The nitrogen gas is pumped from the nitrogen-gas supply portions 53D, 53A, 53B into the corresponding dedicated tanks 51D, 51A, 51B for pressurization. These operations transport the compatibilizer D, the auxiliary A and the auxiliary B toward the mixing valve assembly 42. At this step, however, the inlet valve 43 and the three injection valves are closed.

When a substrate as the process subject is loaded in the processing chamber 11 by means of a handling device such as an industrial robot or a transport mechanism (Step S2), the SCF supply to the processing chamber 11 is started as follows (Step S3). Specifically, in Step S3, carbon dioxide from the reservoir 21 is cooled by the supercooling device 23 so as to be transformed into a liquid state where necessary, and then is pumped to the processing chamber 11 by means of the high-pressure pump 22. While the carbon dioxide thus pumped is heated by the heater 24 so as to be transformed into the supercritical state, there may be cases where carbon dioxide in a sub-supercritical or liquid state is pumped into the processing chamber 11.

In the subsequent Step S4, only the inlet valve 43 of the mixing valve assembly 42 is opened to allow only the compatibilizer D to be injected into the mixing valve assembly 42. Thus, the compatibilizer D alone, as a chemical formulation, is transported to the high-pressure pump 45. Then, the high-pressure pump 45 is brought into operation while the high-pressure valve 46 is opened whereby the chemical formulation (compatibilizer D) is pumped into the SCF so as to be mixed therewith. The resultant mixture, as a process fluid, is pumped to the processing chamber 11.

At completion of the pre-supply of the compatibilizer D, the injection valve for the auxiliary A at the mixing valve assembly 42 is opened while the flow-rate controller portion 44A controls the flow rate of the auxiliary A. Thus, the mixing valve assembly 42 blends the compatibilizer D with the auxiliary A so as to prepare a chemical formulation (D+A). Then, the resultant chemical formulation is mixed with the SCF by means of the high-pressure pump 45 thereby to form a mixture. The resultant mixture, as a process fluid, is pumped into the processing chamber 11 for removing a photoresist adhered to the substrate surface (Step S5). According to the embodiment, the removal of the photoresist is effected by the auxiliary A. At the start of the injection of the auxiliary A, the embodiment controls the flow rate of the auxiliary A based on the predetermined value pre-set in Step S1. Alternatively, however, a so-called ramp-up control may be performed wherein the inflow of the auxiliary A is progressively increased.

The removal of the photoresist is continued for a predetermined period of time and then, the injection valve for the auxiliary A at the mixing valve assembly 42 is closed so that the chemical formulation prepared by the mixing valve assembly 42 is changed from the formulation (D+A) to the formulation (D). As a result, the photoresist removal process is terminated while the components of the auxiliary A remaining in the path extended between the mixing valve assembly 42 and the processing chamber 11 and in the processing chamber 11 are purged by the compatibilizer D (Step S6). It is noted here that at the end of the injection of the auxiliary A, a so-called ramp-down control may be performed wherein the inflow of the auxiliary A is progressively decreased. Such ramp-up/ramp-down controls may also be applied to the start and the end of the injection of the other auxiliaries.

Subsequently, the injection valve for the auxiliary B at the mixing valve assembly 42 is opened while the flow-rate controller portion 44B controls the flow rate of the auxiliary B. Thus, the mixing valve assembly 42 blends the compatibilizer D with the auxiliary B so as to prepare a chemical formulation (D+B). Then, the resultant chemical formulation is mixed with the SCF by means of the high-pressure pump 45 to form a mixture. The resultant mixture, as a process fluid, is pumped into the processing chamber 11 for removal of an etching residue adhered to the substrate surface (Step S7). According to the embodiment, the removal of the etching residue is effected by the auxiliary B.

The removal of the etching residue is continued for a predetermined period of time and then, the injection valve for the auxiliary B at the mixing valve assembly 42 is closed so that the chemical formulation prepared by the mixing valve assembly 42 is changed from the formulation (D+B) to the formulation (D). As a result, the etching-residue removal process is terminated while the components of the auxiliary B remaining in the path extended between the mixing valve assembly 42 and the processing chamber 11 and in the processing chamber 11 are purged by the compatibilizer D (Step S8).

In the subsequent Step S9, the high-pressure valve 46 and the inlet valve 43 of the mixing valve assembly 42 are closed while the high-pressure pump 45 is deactivated to terminate the supply of the chemical formulation. Thus, the process fluid includes the SCF alone, which purges the components of the compatibilizer D in the high-pressure pipe 31 and the processing chamber 11. When the purging process is completed, the high-pressure pump 22 is brought to rest so that the SCF supply to the processing chamber 11 is terminated (Step S10). Thereafter, the pressure in the processing chamber 11 is reduced to normal pressure (Step S11). The depressurizing process performs a so-called supercritical drying of the substrate such that the substrate in a dry state may be unloaded, the substrate sustaining no stain on its surface nor suffering no collapse of a micro-pattern thereon. When the pressure in the processing chamber 11 is returned to the atmospheric pressure, the processed substrate is discharged by the handling device such as the industrial robot or the transport mechanism. Thus are completed a sequence of surface treatment operations, which include the cleaning process (the photoresist removal), a first rinsing process (the etching-residue removal), a second rinsing process and a drying process. Then, the operation flow returns to Step S2 and the aforementioned operations are repeated when the next unprocessed substrate is delivered.

According to the embodiment as described above, some of the four kinds of chemical agents previously prepared for the mixing of the SCF with the chemical agent(s), or specifically the chemical agents A, D (or B, D), are blended together by means of the mixing valve assembly 42 thereby to form a chemical formulation. Thereafter, the resultant chemical formulation is pumped into the SCF by means of the high-pressure pump 45 so as to be mixed with the SCF. Thus, the embodiment can achieve a notable cost reduction of the apparatus by reducing the number of components for pumping the chemical agents (such as the high-pressure pump, high-pressure valve and high-pressure pipe) as compared with the conventional apparatus wherein a plurality of chemical agents are individually pumped to be mixed with the SCF. In this embodiment, a high-pressure region in the chemical-agent supply unit 4 is limited to a region between the high-pressure pump 45 and the high-pressure pipe 31, as shown in FIG. 2, whereas the other regions are at normal pressure. This results in a dramatically reduced number of components to be disposed in the high-pressure region. If, in particular, the number of types of chemical agents to be provided beforehand is increased, what is required is, nonetheless, a single high-pressure pipe 41, a single high-pressure pump 45 and a single high-pressure valve 46. Thus, the embodiment plays a significant role in the cost reduction of the apparatus.

A portion represented by a heavy line in FIG. 2 is the high-pressure pipe through which the SCF and the chemical agent are pumped. As apparent from comparison with a pipe line shown in FIG.1 of Patent Document 1, the high-pressure processing apparatus according to the embodiment has a simplified pipe line for pumping the chemical agent.

Furthermore, since the flow rates of the auxiliaries A-C and the compatibilizer D are controlled by the flow-rate controller portions 44A-44D, respectively, the blending proportions of the chemical agents in the chemical formulation can be set with high accuracies. This also leads to a high-accuracy adjustment of the compositions of the process fluid such that a sequence of surface treatment operations on the substrate (process subject) can be carried out in a favorable manner. In addition, all the flow-rate controller portions 44A-44D perform the feedback control of the flow rate of the chemical agent and hence, the blending proportions can be adjusted with high accuracies. This provides for a stable performance of the surface treatment of an even higher quality. Furthermore, the degree of freedom of the process is also increased remarkably.

According to the embodiment, the first rinsing process using the chemical formulation (D+B) (the etching-residue removal) and the second rinsing process using the chemical formulation (D alone) are sequentially performed in this order. The first rinsing process and the second rinsing process are equivalent to a "first surface treatment" and a "second surface treatment" of the invention, respectively. On the other hand, the compatibilizer D is equivalent to a "first chemical agent" of the invention whereas the auxiliary B is equivalent to "at least one chemical agent other than the first chemical agent" according to the invention. As shown in FIG. 4, the mixing valve assembly 42 for blending these agents has an arrangement wherein the compatibilizer D as the first chemical agent flows through the primary flow path 421. Hence, the compatibilizer D may be stably introduced into the high-pressure pump 45 so that a favorable surface treatment can be carried out.

Figure 6:
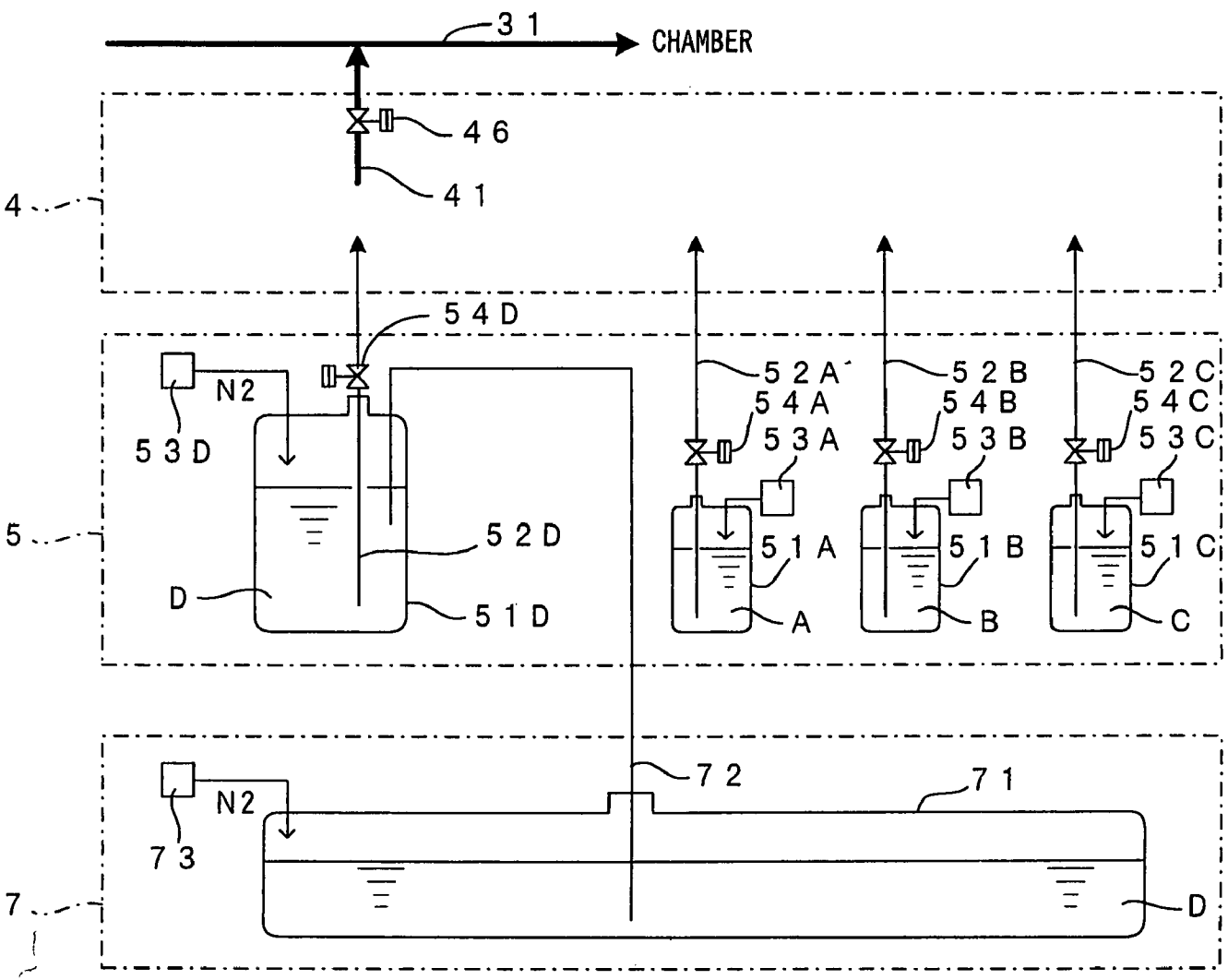
FIG. 6 is a diagram showing a high-pressure processing apparatus according to another embodiment of the invention.

FIG. 6 is a diagram showing a high-pressure processing apparatus according to another embodiment of the invention. A major difference of this embodiment from the foregoing embodiment consists in that, as apparent from comparison between FIGS. 2 and 6, the embodiment (FIG. 6) is provided with an additional replenishment unit 7 for replenishing the compatibilizer D. Otherwise, the principal arrangement of the embodiment is the same as that of the foregoing embodiment. Therefore, the same arrangements will be represented by the same reference characters, respectively, the description of which will be dispensed with. The following description will be made focusing on the difference.

The replenishment unit 7 includes a replenishment tank 71, which stores therein the compatibilizer D as a chemical agent to be replenished according to the embodiment. A leading end of a pipe 72 is dipped in the compatibilizer D whereas a trailing end of the pipe 72 is dipped in the compatibilizer D stored in the dedicated tank 51D. Additionally, a nitrogen-gas supply portion 73 is provided in correspondence to the replenishment tank 71. The nitrogen-gas supply portion 73 pumps nitrogen gas into the replenishment tank 71 thereby feeding the compatibilizer D from the replenishment tank 71 to the dedicated tank 51D via the pipe 72.

When the compatibilizer D stored in the dedicated tank 51D is consumed so that the amount of stored compatibilizer D is decreased to below a predetermined level, the nitrogen-gas supply portion 73 is operated to supply the compatibilizer D from the replenishment tank 71 to the dedicated tank 51D via the pipe 72. This permits the compatibilizer D in the dedicated tank 51D to be constantly maintained above the predetermined level, contributing to an increased operating efficiency of the apparatus.

While the embodiment regards the compatibilizer D as the chemical agent to be replenished, a replenishment tank may be provided in correspondence to each of the other auxiliaries A-C, similarly to the compatibilizer D, such that any of the auxiliaries A-C may be replenished as required.

Figure 7:
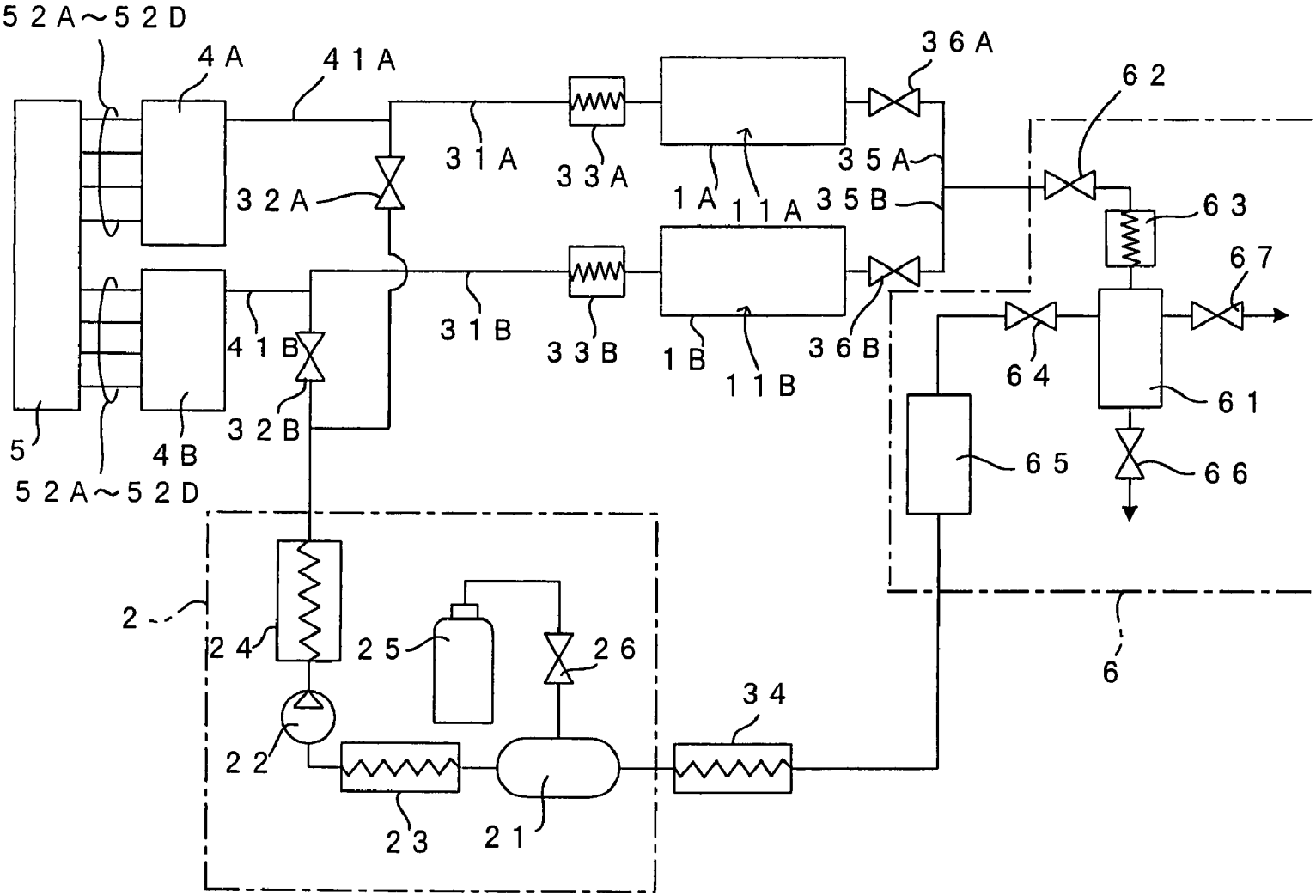
FIG. 7 is a diagram showing a high-pressure processing apparatus according to still another embodiment of the invention.

FIG. 7 is a diagram showing a high-pressure processing apparatus according to still another embodiment of the invention. The embodiment includes two pressure vessels 1A, 1B and is designed to permit independent surface treatments to be performed on substrates inside of the respective pressure vessels 1A, 1B, that is, processing chambers 11A, 11B. Specifically, a chemical-agent supply unit 4A is provided in correspondence to the processing chamber 11A, whereas a chemical-agent supply unit 4B is provided in correspondence to the processing chamber 11B. The embodiment is adapted to supply suitable chemical agents to the processing chambers 11A, 11B in suitable timings, respectively.

In this embodiment, the two chemical-agent supply units 4A, 4B have the same arrangement. Two pairs of pipe groups (pipes 52A-52D) are extended from a single chemical-agent storage unit 5 to the respective chemical-agent supply units 4A, 4B such that four types of chemical agents (the compatibilizer D, auxiliaries A-C) may be supplied to the chemical-agent supply units 4A, 4B. According to the embodiment, tanks in the chemical-agent storage unit 5 function as "common tanks" of the invention.

It is not a requirement of the embodiment that the two chemical-agent supply units 4A, 4B have the same arrangement. An arrangement suited for the content of the surface treatment performed in each of the processing chambers 11A, 11B may be adopted.

In this embodiment, the high-pressure fluid supply unit 2 and the separation/recovery unit 6 are shared by the processing chambers 11A, 11B. Specifically, the high-pressure fluid supply unit 2 is connected with the processing chambers 11A, 11B via high-pressure pipes 31A, 31B respectively, whereas the separation/recovery unit 6 is connected with the processing chambers 11A, 11B via high-pressure pipes 35A, 35B respectively. High-pressure valves 32A, 32B interposed in the respective high-pressure pipes 31A, 31B may be so controlled as to open/close in proper timings thereby selectively supplying the SCF from the high-pressure fluid supply unit 2 to either one of the processing chambers 11A, 11B. On the other hand, high-pressure valves 36A, 36B interposed in the respective high-pressure pipes 35A, 35B may be so controlled as to open/close in proper timings thereby discharging the SCF, chemical agent, contaminants and such from either one of the processing chambers 11A, 11B into the separation/recovery unit 6.

It is noted that the invention is not limited to the foregoing embodiments and various changes and modifications other than the above may be made thereto so long as such changes and modifications do not deviate from the scope of the invention. According to the foregoing embodiments, for instance, the invention is applied to the high-pressure processing apparatus including one or two processing chambers. However, the invention is also applicable to a high-pressure processing apparatus including three or more processing chambers. Where a plural number of processing chambers are provided, an arrangement may be made, similarly to the embodiment shown in FIG. 7, such that the high-pressure fluid supply unit 2 and the separation/recovery unit 6 are shared by the processing chambers. Alternatively, the high-pressure fluid supply unit 2 and the separation/recovery unit 6 may be provided in correspondence to each of the processing chambers.

While the foregoing embodiments employ the mixing valve assembly 42 as the "blending means" for preparing the chemical formulation, the blending means may be composed of a combination of plural pipes and plural on-off valves, as disclosed in the invention of Patent Document 1. However, it is noted that in a case where the blending means including the combination of the pipes and on-off valves is employed, a pipe portion between a junction of the pipes and the on-off valve defines a fluid pool or a so-called dead space, which leads to an incapability of assuredly removing the unwanted chemical agent from the blending means. This leads to a detrimentally lowered accuracy of the blending proportions. In contrast, the adoption of the mixing valve assembly 42 employed by the foregoing embodiments eliminates such a problem, contributing to the increase of the accuracy of the blending proportions, which is advantageous for the high-pressure processing apparatus.

An alternative arrangement may be made wherein the mixing valve assembly 42 is replaced by a chemical mixer tank incorporating therein a stirrer or the like and wherein the chemical agents are blended in the mixer tank before supplied to the high-pressure pump 45. In this case, a plural number of mixer tanks may be provided corresponding to the number of types of chemical agents used. Furthermore, a buffer tank for switching from one chemical agent to another may be interposed between the mixer tank and the high-pressure pump 45.

According to the foregoing embodiments, the sequence of surface treatment operations are performed selectively using three of the four types of chemical agents. However, the surface treatment may be carried out using all the four chemical agents. In addition, the types and number of chemical agents to be used are not limited to those of the foregoing embodiments but suitable combinations may be made according to the nature and composition of the process subject.

According to the foregoing embodiment, the chemical formulation is pumped into the SCF pumped through the high-pressure pipe 31. However, an alternative arrangement may be made such that the chemical formulation is pumped from the chemical-agent supply unit 4, 4A, 4B directly to the processing chamber 11, 11A, 11B.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A high-pressure processing apparatus for subjecting a surface of a process subject to a predetermined surface treatment by allowing a process fluid comprising a high-pressure fluid or a mixture of the high-pressure fluid and a chemical agent to contact the surface of said process subject, said apparatus comprising:

a plurality of pressure vessels each including a processing chamber defined therein for performing said surface treatment;

a plurality of mixing sections, each mixing section supplying the process fluid under pressure to one of said pressure vessels;

a high-pressure fluid supply unit pumping a first fluid under pressure into said plurality of mixing sections;

a plurality of common tanks individually storing therein a respective one of plural chemical agents; and a plurality of chemical-agent supply units, each chemical-agent supply unit corresponding to one of the plural mixing sections and preparing a chemical formulation for the corresponding mixing section by blending all or selected one(s) of said plural chemical agents supplied from said plural common tanks and pumping the chemical formulation under pressure into the corresponding mixing section, wherein the first fluid pumped from said high-pressure fluid supply unit and the chemical formulation pumped from each chemical-agent supply unit are mixed within the corresponding mixing section prior to being supplied to one of the processing chambers as the process fluid;

wherein said apparatus further comprises a high-pressure region and a normal pressure region, a pressure being lower in the normal pressure region than in the high-pressure region, wherein said plurality of pressure vessels and said plurality of mixing sections are positioned in the high-pressure region, wherein each of said plural chemical-agent supply units further comprises:

blending means for blending the chemical agents, the blending means being positioned in the normal pressure region;

a plurality of flow-rate control means each provided corresponding to a respective one of said plural common tanks; and pumping means which is disposed between said blending means and said corresponding mixing section and pumps said chemical formulation blended by said blending means toward said corresponding mixing section, and wherein each of said plural chemical-agent supply units adjusts blending proportions of the individual chemical agents in said chemical formulation by way of said plural flow-rate control means individually controlling the respective flow rates of said plural chemical agents supplied to said blending means.

2. A high-pressure processing apparatus as claimed in claim 1, wherein said plural flow-rate control means each perform a feedback control for controlling the flow rate of the chemical agent supplied to said blending means.

3. A high-pressure processing apparatus as claimed in claim 1, wherein said blending means is a mixing valve assembly.

4. A high-pressure processing apparatus as claimed in claim 1, wherein at least one of said plural chemical agents is a replenishing chemical agent, wherein said tank stores said replenishing chemical agent, and wherein said apparatus further comprises a replenishment section replenishing said tank with said replenishing chemical agent.

5. A high-pressure processing apparatus as claimed in claim 1, further comprising a recovery unit connected to the plurality of pressure vessels and recovering said high-pressure fluid after the surface of the process subject has been subjected to the predetermined surface treatment.

6. A high-pressure processing apparatus as claimed in claim 1, wherein each chemical-agent supply unit includes a pump and a blending section for blending at least one of plural chemical agents to prepare the chemical formulation in an upstream side with respect to said pump, said blending section blends under pressure which is lower than pressure in a downstream side with respect to said pump, and said pump pumps the chemical formulation.

7. A high-pressure processing apparatus as claimed in claim 6, wherein said blending section blends under normal pressure.

* * * * *

UNITED STATES PATENT AND TRADEMARK OFFICE

CERTIFICATE OF CORRECTION

PATENT NO. : 7,562,663 B2
APPLICATION NO. : 10/772546
DATED : July 21, 2009
INVENTOR(S) : Muraoka et al.

It is certified that error appears in the above-identified patent and that said Letters Patent is hereby corrected as shown below:

On Title Page
Item (73) Assignee should read:

Dainippon Screen Mfg. Co., Ltd. (JP)
Kabushiki Kaisha Kobe Seiko Sho (JP)

Signed and Sealed this

Tenth Day of November, 2009

David J. Kappos

David J. Kappos
*Director of the United States Patent and Trademark Office*